US006347759B1

(12) United States Patent
Sedlak

(10) Patent No.: US 6,347,759 B1
(45) Date of Patent: Feb. 19, 2002

(54) GARBAGE DISPOSER MAGNETIC INHIBITOR

(76) Inventor: Peter P. Sedlak, P.O. Box 5001, Sonora, CA (US) 95370

( * ) Notice: Subject to any disclaimer, the term of this patent is extended or adjusted under 35 U.S.C. 154(b) by 0 days.

(21) Appl. No.: 09/630,311

(22) Filed: Jul. 31, 2000

(51) Int. Cl.[7] ..... B02C 18/42

(52) U.S. Cl. ..... 241/301; 241/46.016

(58) Field of Search ..... 209/636, 215, 209/224, 926; 4/DIG. 4; 241/301, 46.013, 46.014, 46.015, 46.016, 81

(56) References Cited

U.S. PATENT DOCUMENTS 4,706,818 A * 11/1987 Zutell et al. ..... 209/636
6,000,643 A * 12/1999 Gelder ..... 241/46.015

* cited by examiner

*Primary Examiner*—Mark Rosenbaum
(74) *Attorney, Agent, or Firm*—Mark C. Jacobs

(57) ABSTRACT

A device to prevent inadvertent introduction of metal material into a household garbage disposer grinder. The device comprises a flexible magnetic whose ends are retained in an H-shaped retainer and which is disposed around the entrance to the disposer to form a magnetic field across the entrance so that ferrous metals will be attracted to the magnet and therefore will stick thereto, and thus not fall into the hopper of the disposer.

10 Claims, 2 Drawing Sheets

GARBAGE DISPOSER MAGNETIC INHIBITOR

FIELD OF THE INVENTION

This invention pertains to household and commercial garbage disposers and a device to inhibit entry of iron/steel items into the disposer.

BACKGROUND OF THE INVENTION

Garbage disposers have been used in households and commercial establishments such as restaurants, hotels, inns, as well as butcher shops and grocery stores on a large scale since the 1950's. These work on the principle that material introduced through a neck at the sink bottom into a hopper is spun around at high speed. As the waste is spun around, it impacts impellers mounted in the floor of the hopper, which impellers can also serve as cutters. Other cutting edges are mounted on the sidewall of the hopper. As the hopper rotates at high speed, the centrifugal force displaces the waste material at the cutters and cutting edges. Here the relatively soft waste food, and even some bones are chopped up into small pieces to be washed down the drain with cold water (preferably) that enters through the neck of the disposer, from the faucet of the sink. Home use disposers have motors that vary from about $1/3^{rd}$ to ¾ hp. The stronger the motor the more expensive and better the grinding operation as more food waste, vegetable ends and peelings will be consumed and to a greater degree.

Unfortunately, people are prone to have accidents. From time to time, a stainless steel fork or other ferrous containing utensils might fall into the disposer. More often than not, the fork or other utensils comes out with nicks and cuts, or is broken into several parts—all with the space of a few seconds from the time of actuation of the disposer. In addition the impellers are subject to breakage and the grinding edges can become quickly worn.

But accidents do happen, and especially in households where children partake in cleanup after dinner as well as in salad or other food preparation chores prior to the meal.

Thus the need for a device to inhibit the accidental introduction of steel/iron objects into the disposer is seen to be of benefit to many people.

It is one object of this invention to provide a device that inhibits the entry of stainless flatware and other kitchen utensils, such as corn cob holders from falling into the hopper of a garbage disposer.

It is a second object to provide a magnetic inhibitor for metallic objects to be disposed around the mouth of a garbage disposer.

It is a third object to provide an annular magnetic sized to fits within the throat of a garbage disposer to prevent entry of ferrous utensils into the disposer.

These and other objects can be accomplished by the provision of a flexible coated magnetic strip that can be bent into a circle for retention by a gripping member, which magnetic strip when lent and retained form the annular device of this invention. An H-shaped member is used to retain the two ends of the magnetic in the form of a circle.

Other objects of the invention will in part be obvious and will in part appear hereinafter.

The invention accordingly comprises the device possessing the features properties and the relation of components which are exemplified in the following detailed disclosure and the scope of the application of which will be indicated in the appended claims.

For a fuller understanding of the nature and objects of the invention reference should be made to the following detailed description, taken in conjunction with the accompanying drawings.

Applicant is aware of only one relevant U.S. Patent, that being Van Gelder, U.S. Pat. No. 6,000,643, who deploys a segmented ceramic magnet. The device of this patent application is significantly better than the prior art in carrying out the assigned task; protecting the neck of the disposer from the entry of magnetic objects.

SUMMARY OF THE INVENTION

The device of this invention is a cylindrical member produced from a flexible elongated strip magnet which is rolled into an interrupted circle, the interruption being free space, and the ends of which are then placed into an H-shaped retainer, to form a short elevation cylinder for insertion into the throat of a garbage dispenser above the multi-fingered rubber membrane positioned at the top of the throat of the disposer.

DESCRIPTION OF THE PREFERRED EMBODIMENT

Figure 1:
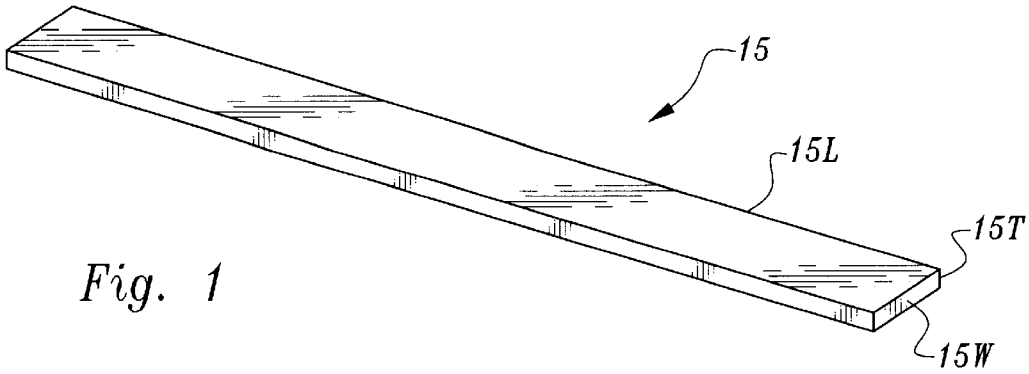
FIG. 1 is top perspective view of the first portion of this invention prior to product formation.
Figure 2:
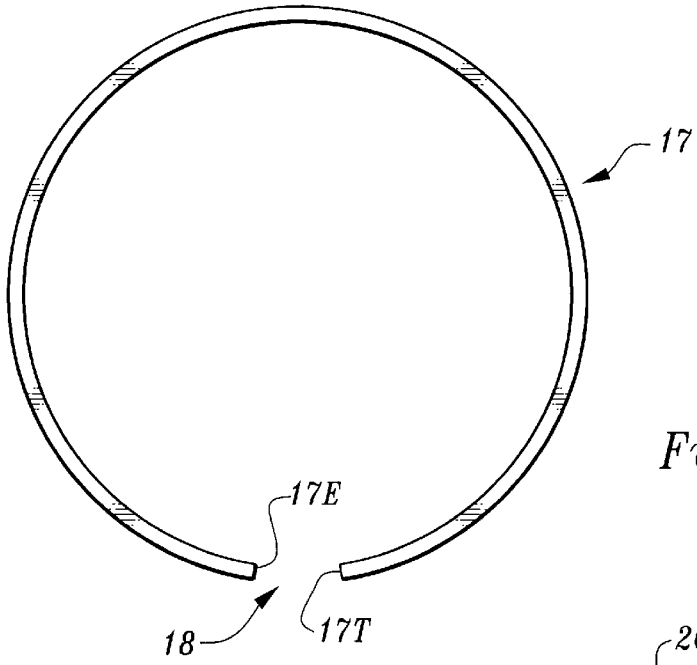
FIG. 2 is a top plan view of the first portion of this invention during the course of product formation.

In FIG. 1 there is shown an elongated flexible strip magnet 15 of a finite length usually about 10 inches. The length of the strip is designated 15L, while the thickness is 15T, and the width is designated 15W. The thickness can vary from about 1/32nd of an inch to about 1/8th inch. Strip magnets as are known are formed from tiny magnetic particles that are mixed with a resinous material and formed into magnetic sheets and then cut into strips of the desired length. Strip magnets are available in the marketplace from such vendors as the 3M Company The strip magnet 15 is then rolled over a mandrel, to form an interrupted circle 17 as per FIG. 2. The free space 18 constitutes the interruption to the circle. Each end of the rolled magnet 17 is designated 17E, while the thickness also shown adjacent the end is designated 17T. Thickness 17T is the same as thickness 15T, the strip having been transformed into the interrupted circle 17.

Figure 3:
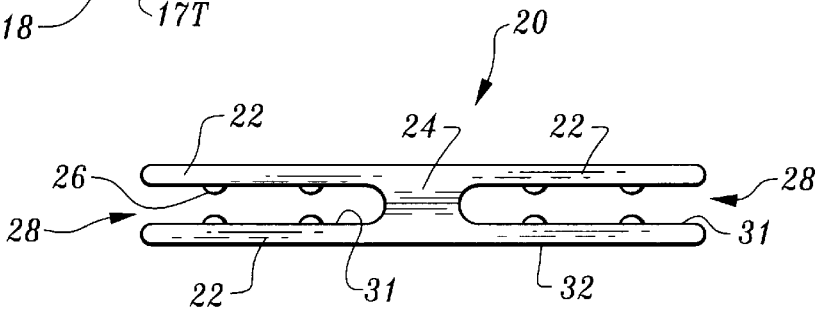
FIG. 3 is a top plan view of the retainer member forming the second portion of this invention.

FIG. 3 is a top plan view of the retainer member of this invention. It is as seen, an H-shaped member having a pair of spaced parallel arms 22, joined across their midpoints by a cross-member 24. A pair of linearly aligned spaced slots 28 separates each of the two arms 22. Disposed on the interior side 31 of each arm 22's sidewall 30 is a multiplicity of inwardly extending bosses 26. These bosses or teeth 26 are intended to grab the rolled magnet and retain it in place, when the rolled magnet 17 has each end 17E inserted into a respective one of the slots 28.

Figure 4:
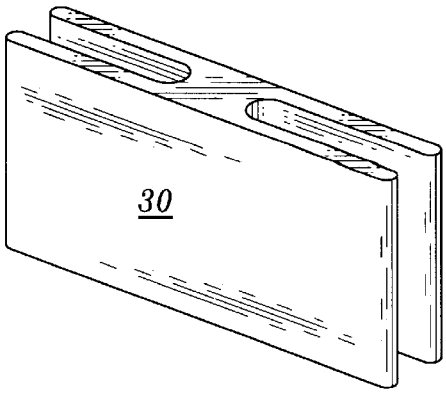
FIG. 4 is a front perspective view of the retainer portion of this invention.

As seen in FIG. 4, the sidewall of the retainer 20 is designated 30 while the exterior surface thereof is shown as 32 in FIG. 3. The retainer is may be made from any moldable plastic such as nylon, Delrin®, polypropylene among others, and may be either white or colored to match the sink such as almond or bone, or gunmetal to match stainless steel, or any other color to match a manufacturer's sink colors. Preferably the retainer is somewhat flexible such that it can be curved to better fit the sink next neck or it can be made arcuate at the time of manufacture for the same reason.

Figure 5:
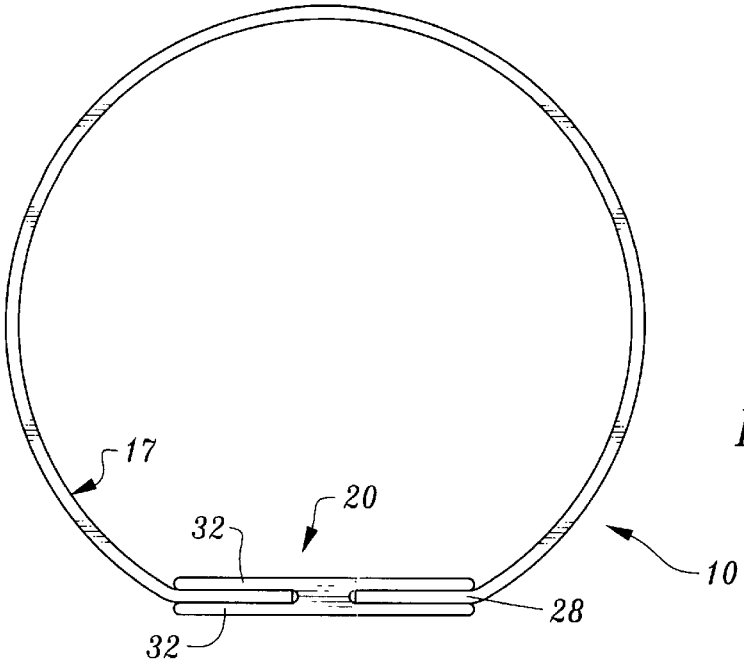
FIG. 5 is a top plan view of the device of this invention.

In FIG. 5, it is seen that the two ends 17E of rolled magnet 17 have been inserted into respective slots 28. Pressure is then applied as by hand, by squeezing the two exterior surfaces 32 of the retainer 20 between the thumb and index finger such that the bosses 26 bite into the relatively soft rolled magnet 17 to maintain each end thereof in the retainer 20. FIG. 5 also demonstrates that the that the optional bosses shown in FIG. 3 may be omitted. While such may provide for a better locking of the strip magnet into place, the use of such bosses will add significantly to the cost of manufacture. Note also that FIG. 5 illustrates the fact that the retainer may be manufactured in an arcuate shape to better ensure a good fit in the neck of the sink.

Use of Device

Figure 6:
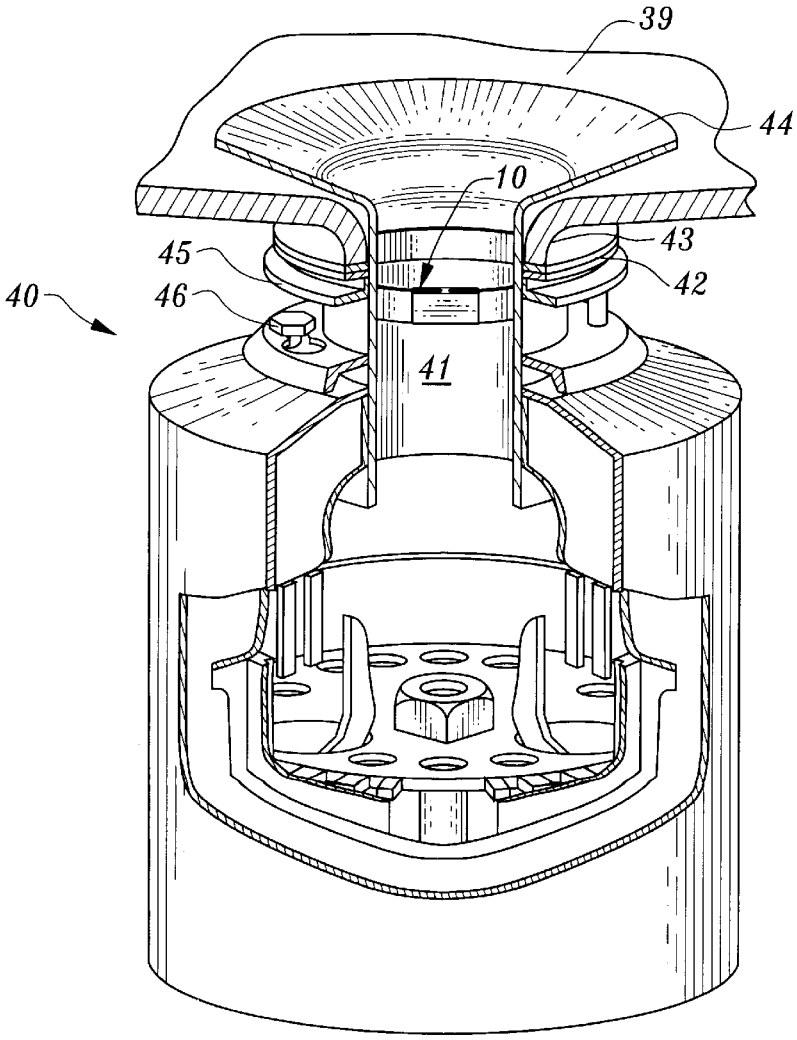
FIG. 6 is a partial cutaway perspective view showing the device of this invention installed for use.

FIG. 6 illustrates a typical commercially available garbage disposer sold by such vendors as Emerson Electric, General Electric and KitchenAid among others. Disposer 40 is seen to be mounted by a mount ring 45 held in place by bolts 46 at a location beneath the sink floor 39. The entry into the disposer is designated throat 41 and is positioned above the multi-fingered rubber membrane 42 which in turn is positioned above the neck 43 of the disposer, which neck connects the throat 41 to the hopper 44. It is in the hopper 44 that the grinding transpires.

As can be seen in FIG. 6, device 10 is mounted within the neck area 41. The diameter of the device 41 is preordained by the diameter of the neck 41 of the disposer 40. The neck being made of steel, as aluminum is too soft, readily receives the circular magnetic device in a magnetic frictional engagement.

When and as any magnetic item such as a fork or spoon or kitchen utensil or even a steel toy is dropped or placed anywhere near the throat of the disposer, it will be magnetically attracted by the device of this invention and thus prevented from slipping through the membrane 42 into the hopper 44 to be ground up. Damage to the internal workings of the disposer are thus prevented by the device of this invention.

Comparison Testing

The following tests were carried out utilizing the flexible rubber material magnet of this invention versus the magnetized ceramic segments disposed within a flange of the Van Gelder patent.

1. The resinous ring having magnetic particles therein took about 8 seconds+/−1 second to install, and at no time was the device in jeopardy of falling into the opening or neck of the disposal. Whereas due to the hard nature of the individual ceramic segments, totally assembly time was about 4 minutes the first time and 3 minutes the second opportunity to do so, due to the fact that individual segments tend to fall out of the flange into the hopper of the disposer. Indeed persons with manual dexterity problems will have difficulty in assembling the device of Van Gelder.

2. Should the device of this invention have the interrupted circle portion dislodge from the H-shaped retainer, both portions are large enough to be easily retrieved by hand, as by placing the hand into a stopped hoper to retrieve the piece in question. Whereas if one or more segments comes loose from the flange, retrieval is next to impossible, due to small size of each segment and no outside light reaches the hopper floor.

3. The interrupted ring aspect of this device was purposely placed into the disposer and the current applied for 3 seconds. Upon removal it was determined that while there were visible nicks and cuts present on the magnetic strip, upon re-assembly it functioned satisfactorily. In another test, the retainer portion was also nicked but still retained the strip in the slots.

While no lockup occurred during the test with the segments ceramic magnet, it is not beyond the realm of possibility that such could transpire if a piece of ceramic became wedged to prevent rotation of the hopper. A short circuit leading to fire is but a possible result of such an accident.

When one segment of the ceramic segmented magnet was manually removed and placed in the disposer and power applied for 3 seconds, the unit completely stopped functioning. Upon examination it was found that the segment that had been made according to the Van Gelder patent had been broken into several pieces, the largest being about 0.115 inches in diameter, the size of a pea. Ceramic particulates were found to be present upon inspection with a flashlight, such that the disposer needed to be disassembled form the sink and held upside down to spray out the ground up ceramic particles with a water stream. The blades of the disposer and impellers appeared dulled by the moving ceramic material.

4. When young children of the age of 5 were asked to remove the device of this invention, they were unable to do so. But the young children were able to remove individual segments of the ceramic magnetic from its flange after about 2 minutes of activity. The fear by the parents of possible ingestion was high. But there was no fear of ingestion of the big strip magnet, assuming the child of 5 could figure out how to separate it from the H-shaped retainer.

5. To test magnetic attraction of items dropped from washing height, about 15 inches above the sink, a table spoon, a teaspoon, a knife, a potato peeler, an 8 penny nail and a one inch wood screw and a nut were all dropped into a sink with each of the two devices in position. The unit of this invention showed superior results in the ability to hold the items listed on initial contact. The rolled magnetic strip is softer and thus exhibited far superior shock absorption properties on initial contact with these objects. The hard surface of the ceramic magnet caused the items to bounce slightly upon impact. It took three tries to get all items to magnetically stick, but for the knife and wood screw which took two tries. All items immediately stuck on first try to the device of this invention. Thus there is less fear of inadvertent passage into the throat of the disposer with the device of this invention.

6. Upon inspection of the neck area of each of the disposers upon removal of the two devices respectively, it was found that minor scratch lines large enough to harbor bacteria and possibly create an odor, were present in the ring to which the ceramic segmented magnet had been applied. No such degradation was found upon removal of the device of this invention. The scratches were believed caused by the pressure needed to place all segments in the flange to create the ring encircling the neck of the disposer. The more the units were removed for cleaning, the more scratched the neck of the ceramic magnet disposer became. It should also be mentioned that in the removal for cleaning operation, the possibility of one or more segments of the ceramic magnet falling into the hopper is always present.

Indeed, even a misplaced chicken bone could dislodge one or more segments of the ceramic magnet. Small bones had no effect on the placement of the magnetic device of this invention. And neither the bones nor did any kitchen implement knock off the H-shaped retainer from the magnetic circle in the dropping test above.

It is also found that if the H-shaped retainer is thin enough the magnetic quality of the device is NOT lost within that section of the magnetic strip disposed within the holder.

It was also found that coating of the flexible magnetic with a thin layer of a suitable paint to color the unit to match the sink, such as almond or white had no deleterious effect upon the magnetic qualities of the device.

It is seen that I have produced a superior form of shield against the accidental incursion of magnetic items into the hopper of a garbage disposer.

Since certain changes may be made in the above described device without departing from the scope of the invention herein involved, it is intended that all matter contained in the above description and shown in the accompanying drawings shall be interpreted as illustrative and not in a limiting sense.

I claim:

1. A device to inhibit the entry of ferrous items into the neck of a garbage disposer, which device comprises:

(a) a flexible strip magnet made of a polymeric resinous binder and magnetic particles, formed into an interrupted circle having two ends, and (b) an H-shaped member having a pair of spaced parallel arms each of which has a sidewall, joined across their midpoints by a cross-member, with a pair of spaced linearly aligned slots separating the two arms, and wherein disposed on the interior side of each arm sidewall is a multiplicity of bosses extending inwardly into said slots, for retention of said strip magnet;

wherein one end of said strip magnet is inserted into each of said pair of slots and retained therein.

2. In the device of claim 1 wherein the H-shaped member is made of plastic.

3. The device of claim 1 wherein the magnet is coated with a color to match a sink.

4. The device of claim 1 wherein the H-shaped retainer is flexible.

5. The device of claim 1 wherein the H-shaped retainer is made arcuate.

6. A device to inhibit the entry of ferrous items into the neck of a garbage disposer, which device comprises:

(a) a flexible strip magnet made of a polymeric resinous binder and magnetic particles, formed into an interrupted circle having two ends, and (b) an H-shaped member having a pair of spaced parallel arms each of which has a sidewall, joined across their midpoints by a cross-member, with a pair of spaced linearly aligned slots separating the two arms, for retention of said strip magnet;

wherein one end of said strip magnet is inserted into each of said pair of slots and retained therein.

7. In the device of claim 6 wherein the H-shaped member is made of plastic.

8. The device of claim 6 wherein the magnet is coated with a color to match a sink.

9. The device of claim 6 wherein the H-shaped retainer is flexible.

10. The device of claim 6 wherein the H-shaped retainer is made arcuate.

* * * * *